US008517081B2

(12) United States Patent
Huang

(10) Patent No.: US 8,517,081 B2
(45) Date of Patent: Aug. 27, 2013

(54) TRANSMISSION ASSEMBLY FOR A ROLLER BLIND

(75) Inventor: Wen-Chong Huang, Taipei (TW)

(73) Assignee: K.E. & Kingstone Co., Ltd., Taipei (TW)

( * ) Notice: Subject to any disclaimer, the term of this patent is extended or adjusted under 35 U.S.C. 154(b) by 0 days.

(21) Appl. No.: 13/208,007

(22) Filed: Aug. 11, 2011

(65) Prior Publication Data

US 2013/0037225 A1 Feb. 14, 2013

(51) Int. Cl.
*E06B 9/17* (2006.01)

(52) U.S. Cl.
USPC ..... 160/297; 160/309; 160/294; 160/313

(58) Field of Classification Search
USPC ..... 160/313, 309, 294, 297, 170; 242/394
See application file for complete search history.

(56) References Cited

U.S. PATENT DOCUMENTS

| | | | | | |
|---|---|---|---|---|---|
| 2,487,741 | A * | 11/1949 | Stuber | 160/297 |
| 2,586,340 | A * | 2/1952 | Hyde | 160/297 |
| 2,614,629 | A * | 10/1952 | Hermann | 160/297 |
| 4,009,745 | A * | 3/1977 | Erpenbeck | 160/297 |
| 4,250,942 | A * | 2/1981 | Dreher et al. | 160/297 |
| 4,305,447 | A * | 12/1981 | Persson | 160/297 |
| 4,345,636 | A * | 8/1982 | Fukuchi | 160/297 |
| 4,662,423 | A * | 5/1987 | Ishii | 160/293.1 |
| 5,099,906 | A * | 3/1992 | Chigusa et al. | 160/297 |
| 5,566,741 | A * | 10/1996 | Ogawara et al. | 160/297 |
| 6,529,323 | B2 * | 3/2003 | Okumura | 359/461 |
| 7,665,507 | B2 * | 2/2010 | Naoki | 160/308 |
| 8,191,605 | B2 * | 6/2012 | Kwak | 160/319 |
| 8,281,846 | B2 * | 10/2012 | Zhu | 160/319 |
| 2010/0314054 | A1 * | 12/2010 | Zhu | 160/294 |
| 2012/0298318 | A1 * | 11/2012 | Wolek | 160/299 |

* cited by examiner

*Primary Examiner* — Katherine Mitchell
*Assistant Examiner* — Johnnie A Shablack
(74) *Attorney, Agent, or Firm* — Birch, Stewart, Kolasch & Birch, LLP

(57) ABSTRACT

A transmission assembly for a roller blind has a mounting frame, a roller, a coil spring, a spring axle, a turning element, a torsional spring, a major damper, a positioning device and a blind cloth device. The roller is mounted in the mounting frame. The coil spring is mounted in the roller. The spring axle is mounted in the coil spring. The turning element is connected to the spring axle. The torsional spring is mounted in the turning element. The major damper is connected to the coil spring and has a turning rod. The positioning device is mounted in the roller and has a rotating mount, a rail mount and a positioning ball. The rail mount is mounted in the rotating mount and has two rails. The positioning ball is mounted between the rotating mount and the rails. The blind cloth device is mounted the mounting frame.

4 Claims, 14 Drawing Sheets

TRANSMISSION ASSEMBLY FOR A ROLLER BLIND

BACKGROUND OF THE INVENTION

1. Field of the Invention

The present invention relates to a transmission assembly, and more particularly relates to a transmission assembly for a roller blind that can hold a blind cloth of the roller blind on a desired height and can roll the blind cloth up automatically and easily.

2. Description of Related Art

Conventional shades or blinds are generally used in the building decoration, include pleated shades, honey combs, roman shades and roller blinds. The conventional roller blind usually has a transmission assembly, a blind cloth and a lift cord. The transmission assembly is mounted on a side of a window frame. The blind cloth is rolled around the transmission assembly. The lift cord is connected to the transmission assembly and can be pulled to control the expansion or retraction of the blind cloth via the transmission assembly. However, the lift cord is hanged down at a side of the conventional roller blind, and a child is easily tied by the conventional lift cord to cause accidents.

Therefore, a cordless transmission assembly of the conventional roller blind is provided and has a mounting frame, a torsional spring, a connecting cord, a lower bar and a blind cloth. The mounting frame is mounted securely on a side of a window frame. The torsional spring is mounted in the mounting frame and has two ends. One of the ends of the torsional spring is connected to the mounting frame. The connecting cord is connected to the other end of the torsional spring and has a lower end. The lower bar is connected to the lower end of the connecting cord opposite to the torsional spring. The blind cloth is mounted between the mounting frame and the lower bar. The torque force of the torsional spring is equal to the weight of the blind cloth and the lower bar to hold the blind cloth at a desired height. Although the cordless conventional roller blind has been provided to a hold the blind cloth in place, the conventional cordless transmission assembly cannot be rolled up easily and automatically especially when the conventional roller blind is set at a high position.

To overcome the shortcomings, the present invention provides a transmission assembly for a roller blind to mitigate or obviate the aforementioned problems.

SUMMARY OF THE INVENTION

The main objective of the present invention is to provide a transmission assembly for a roller blind that can hold a blind cloth of the roller blind on a desired height and can roll the blind cloth up automatically and easily.

The transmission assembly for a roller blind in accordance with the present invention has a mounting frame, a roller, a coil spring, a spring axle, a turning element, a torsional spring, a major damper, a positioning device and a blind cloth device. The roller is rotatably mounted in the mounting frame. The coil spring is mounted securely in the roller. The spring axle is mounted in the coil spring. The turning element is connected to the spring axle. The torsional spring is mounted securely in the turning element. The major damper is connected securely to the coil spring and has a turning rod. The positioning device is mounted securely in the roller, rotatably abuts the spring axle and has a rotating mount, a rail mount and a positioning ball. The rail mount is mounted in the rotating mount and has two rails, multiple guiding protrusions and multiple guiding blocks. The positioning ball is rotatably mounted between the rotating mount and the rails of the rail mount. The blind cloth device is mounted the mounting frame and has a blind cloth connected to the roller.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
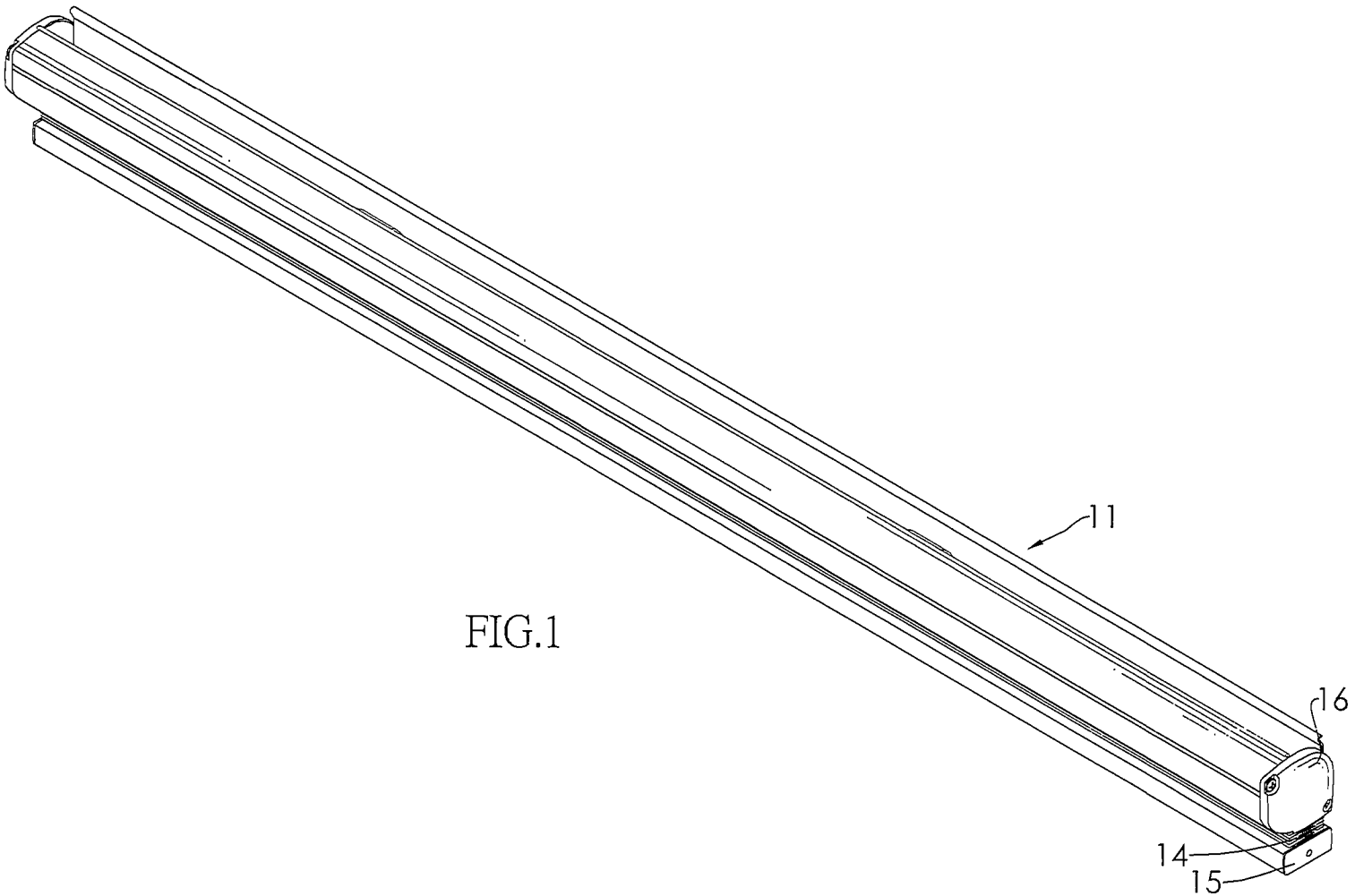
FIG. 1 is a perspective view of a first embodiment of a transmission assembly for a roller blind in accordance with the present invention.

With reference to FIGS. 1 to 3, 5, 18 and 22, a transmission assembly for a roller blind in accordance with the present invention comprises a mounting frame 11, 11B, 11C, at least one winding device 30, 30B, a roller 12, 12B, a coil spring 13, 13B, a spring axle 21, 21B, a turning element 24, a torsional spring 23, a major damper 22, 22B, two side covers 16, 16B, a positioning device 40, 40B and a blind cloth device.

The mounting frame 11, 11B, 11C is hollow, is mounted on a side of a window frame and has two open ends and a bottom.

Figure 2:
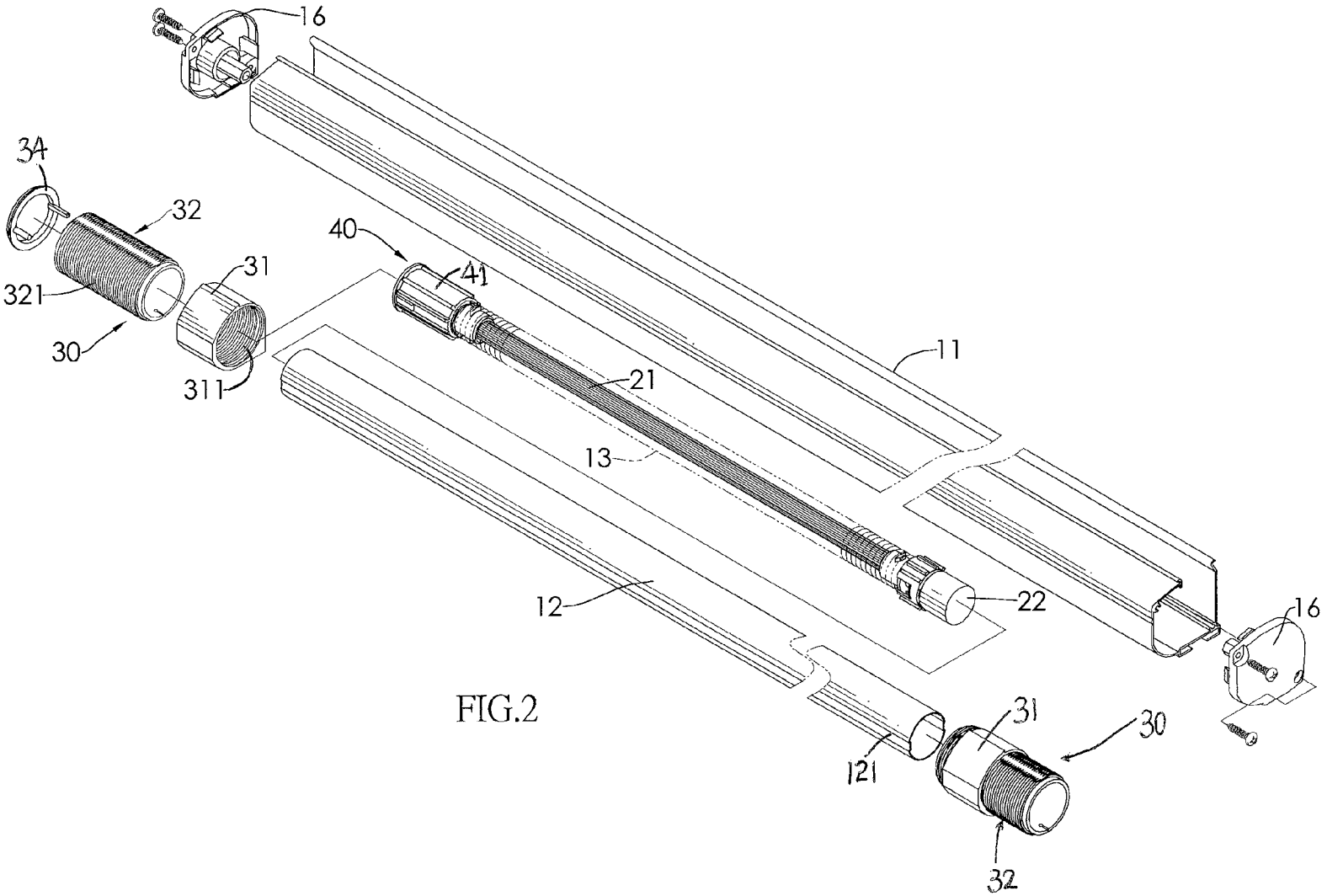
FIG. 2 is an exploded perspective view of the transmission assembly for a roller blind in FIG. 1.
Figure 4:
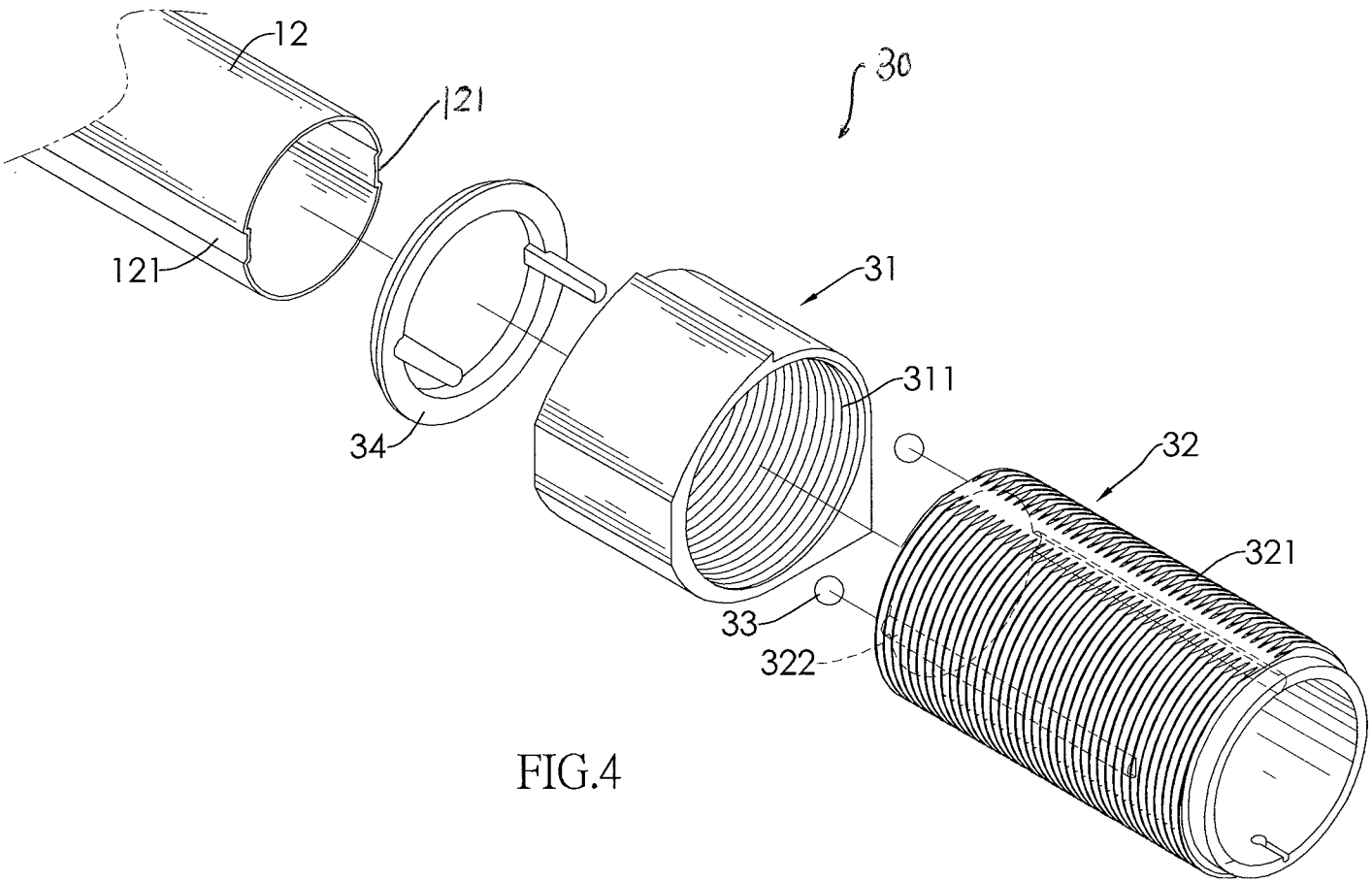
FIG. 4 is an enlarged exploded perspective view of a winding device of the transmission assembly for a roller blind in FIG. 2.
Figure 18:
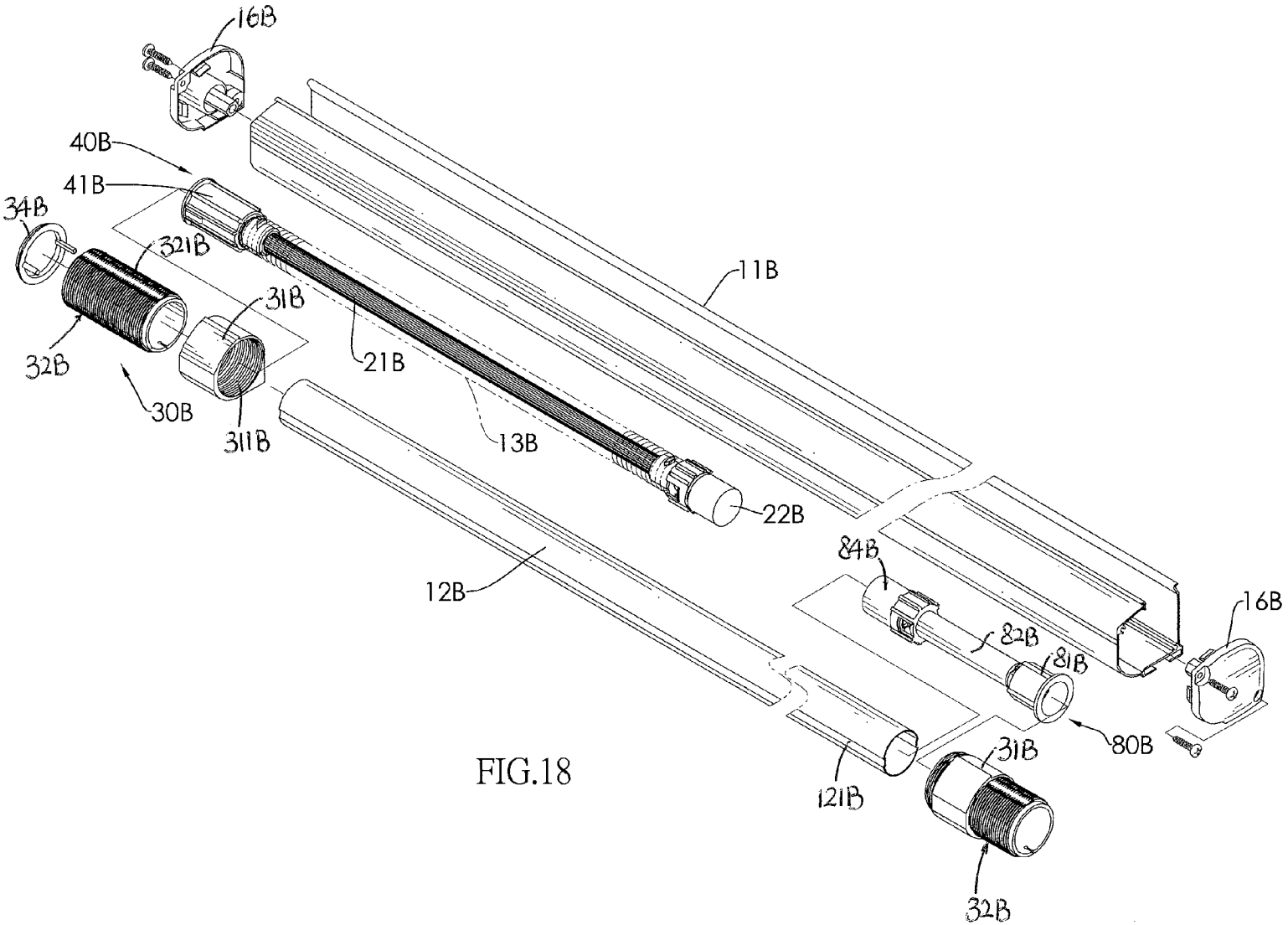
FIG. 18 is an exploded perspective view of a second embodiment of a transmission assembly for a roller blind in accordance with the present invention.
Figure 19:
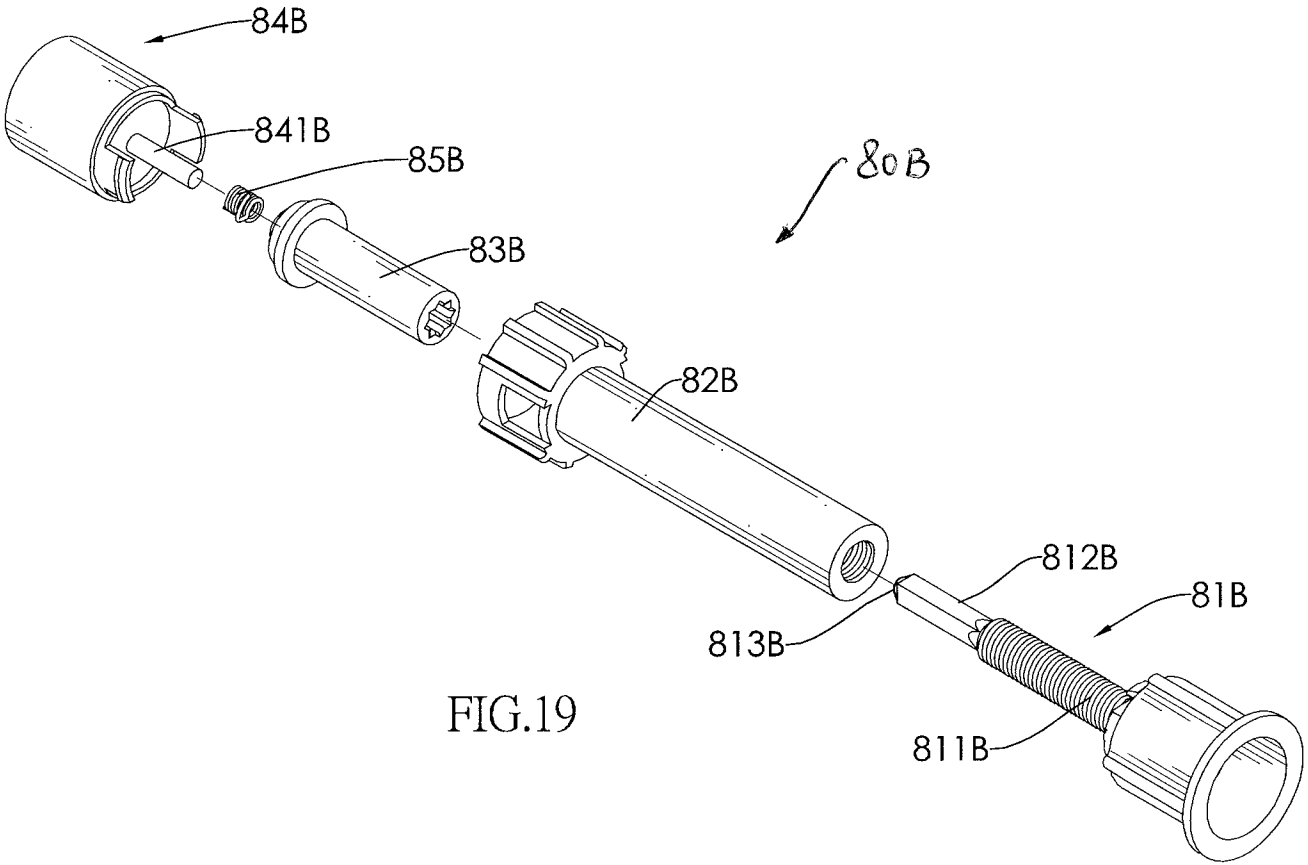
FIG. 19 is an enlarged exploded perspective view of a damping device of the transmission assembly for a roller blind in FIG. 18.
Figure 20:
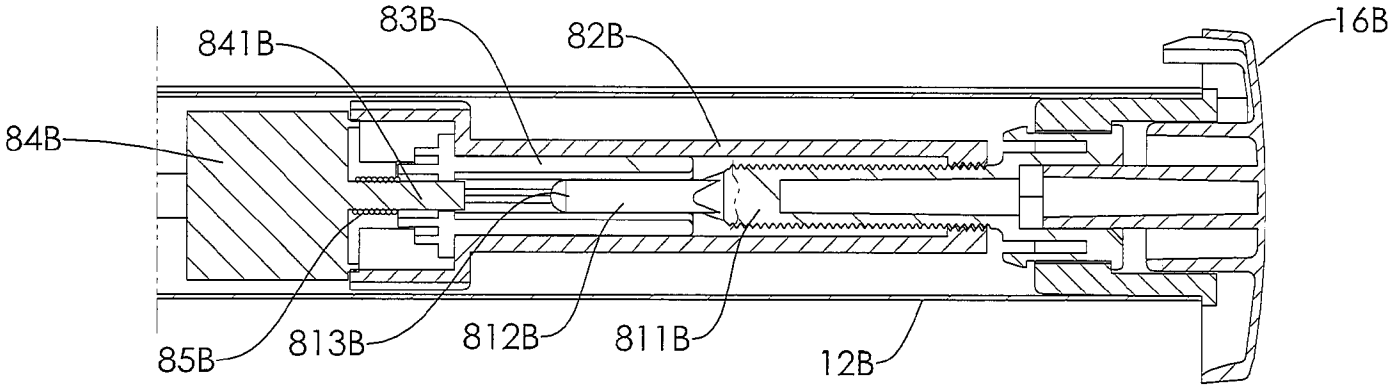
FIG. 20 is an enlarged side view in partial section of the transmission assembly for a roller blind in FIG. 18.

With reference to FIGS. 2, 4 and 18, the at least one winding device 30, 30B is mounted in the mounting frame 11, 11B and has a mounting sleeve 31, 31B, a winding jacket 32, 32B, two winding balls 33 and a stopping ring 34, 34B. The mounting sleeve 31, 31B is hollow, is mounted securely in the mounting frame 11, 11B and has two open ends, an internal surface and an inner thread 311, 311B. The inner thread 311, 311B is formed on the internal surface of the mounting sleeve 31, 31B.

The winding jacket 32, 32B is hollow, is rotatably mounted in the mounting sleeve 31, 31B and has two open ends, an external surface, an internal surface, an outer thread 321, 321B and two ball recesses 322. The open ends of the winding jacket 32, 32B respectively extend out of the open ends of the mounting sleeve 31, 31B. The outer thread 321, 321B is formed around the external surface of the winding jacket 32, 32B and is screwed with the inner thread 311, 311B of the mounting sleeve 31, 31B. The ball recesses 322 are formed in the internal surface of the winding jacket 32 and are formed through one of the open ends of the winding jacket 32.

The winding balls 33 are rotatably and respectively mounted in the ball recesses 322 of the winding jacket 32. The stopping ring 34, 34B is mounted on a corresponding open end of the winding jacket 32, 32B through which the ball recesses 322 are formed and has two stopping arms respectively mounted in the ball recesses 322 of the winding jacket 32, 32B. Preferably, the transmission assembly for a roller blind in accordance with the present invention has two winding devices 30, 30B mounted in the mounting frame 11, 11B at an interval.

Figure 3:
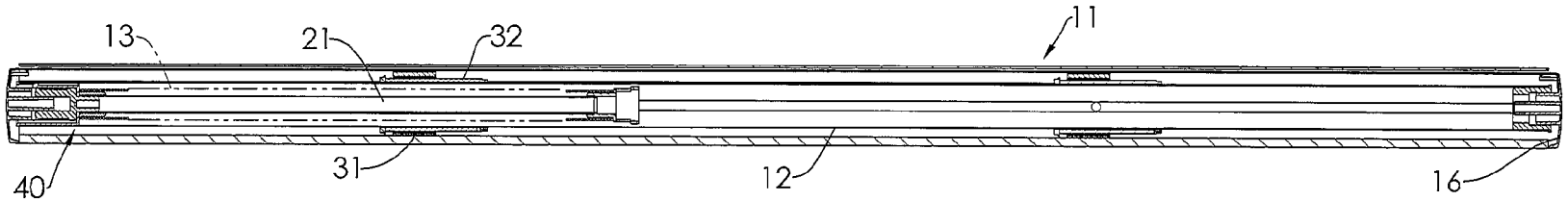
FIG. 3 is a top view in partial section of the transmission assembly for a roller blind in FIG. 1.

With reference to FIGS. 2, 3 and 18, the roller 12, 12B is rotatably mounted in the mounting frame 11, 11B, is securely connected to the winding jacket 32, 32B of the at least one winding device 30, 30B and has an external surface and two ball grooves 121, 121B. The ball grooves 121, 121B are formed in the external surface of the roller 12, 12B and respectively align with the ball recesses 322 of the winding jacket 32 to hold the winding balls 33 between the ball grooves 121, 121B of the roller 12, 12B and the ball recesses 322 of the winding jacket 32. Then, the roller 12, 12B can be rotated with the winding jacket 32, 32B in a same direction and can be moved relative to the winding jacket 32, 32B axially.

Figure 5:
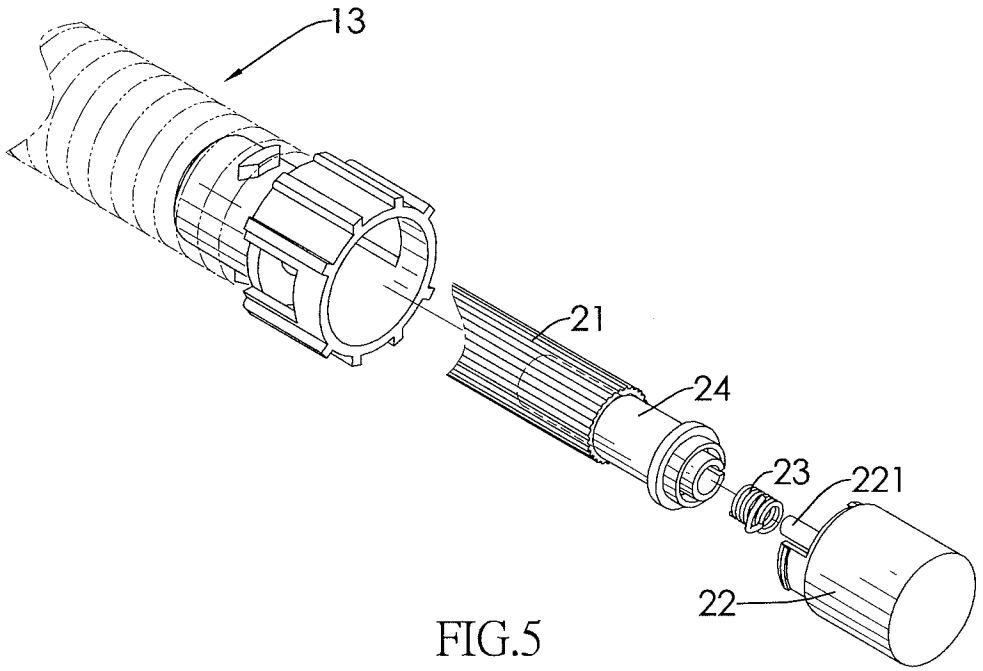
FIG. 5 is an enlarged exploded perspective view of the transmission assembly for a roller blind in FIG. 2.

With reference to FIGS. 2, 5 and 18, the coil spring 13, 13B is mounted securely in the roller 12, 12B and has an inner end and an outer end. The inner end of the coil spring 13, 13B is mounted securely in the roller 12, 12B. The spring axle 21, 21B is mounted in the coil spring 13, 13B between the ends of the coil spring 13, 13B and has an inner end and an outer end. The turning element 24 is connected to the inner end of the spring axle 21, 21B and has an inserting end and a mounting end. With reference to FIG. 5, the inserting end of the turning element 24 is mounted securely in the inner end of the spring axle 21, 21B.

The torsional spring 23 is mounted securely in the mounting end of the turning element 24. The major damper 22, 22B is connected securely to the end of the coil spring 13, 13B that is securely mounted in the roller 12, 12B, is connected securely to the torsional spring 23 and has an inner side and a turning rod 221. The turning rod 221 is formed on and protrudes from the inner side of the major damper 22, 22B and is mounted securely in and abuts securely the torsional spring 23. With reference to FIGS. 2 and 18, the side covers 16, 16B are respectively connected to the open ends of the mounting frame 11, 11B to hold the roller 12, 12B in the mounting frame 11, 11B. The turning element 24, the torsional spring 23 and the major damper 22, 22B can provide a buffering effect to the spring axle 21, 21B.

Figure 6:
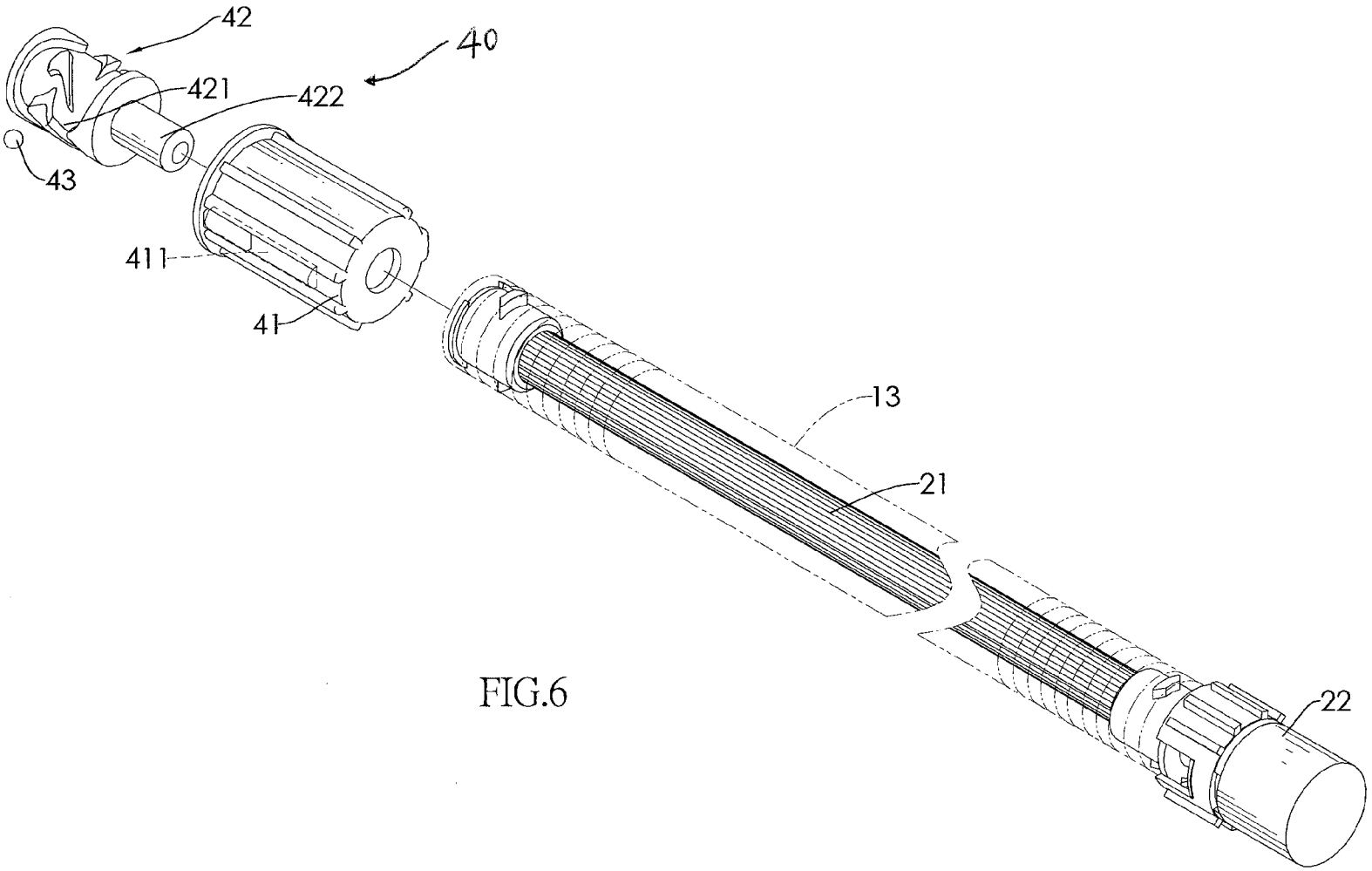
FIG. 6 is an enlarged exploded perspective view of a positioning device of the transmission assembly for a roller blind in FIG. 2.

With further reference to FIGS. 2, 6 and 18, the positioning device 40, 40B is mounted securely in the roller 12, 12B, is connected securely to one of the side covers 16, 16B, rotatably abuts the outer end of the spring axle 21, 21B and has a rotating mount 41, 41B, a rail mount 42 and a positioning ball 43. The rotating mount 41, 41B is hollow, is mounted securely in the roller 12, 12B and has two open ends, an internal surface and a ball channel 411. One of the open ends of the rotating mount 41, 41B rotatably abuts the outer end of the spring axle 21, 21B. The ball channel 411 is formed longitudinally in the internal surface of the rotating mount 41, 41B.

The rail mount 42 is mounted in the rotating mount 41, 41B, is mounted securely on the corresponding side cover 16 that is connected to the rotating mount 41, 41B and has a mounting segment 422 and a rail segment 421. The mounting segment 422 of the rail mount 42 extends through one of the open ends of the rotating mount 41, 41B and is connected securely to the outer ends of the coil spring 13, 13B and the spring axle 21, 21B.

Figure 7:
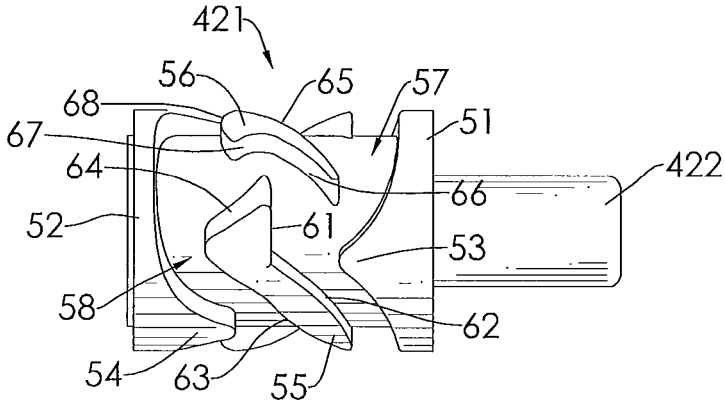
FIG. 7 is an enlarged side view of a rail mount of the positioning device in FIG. 6.
Figure 8:
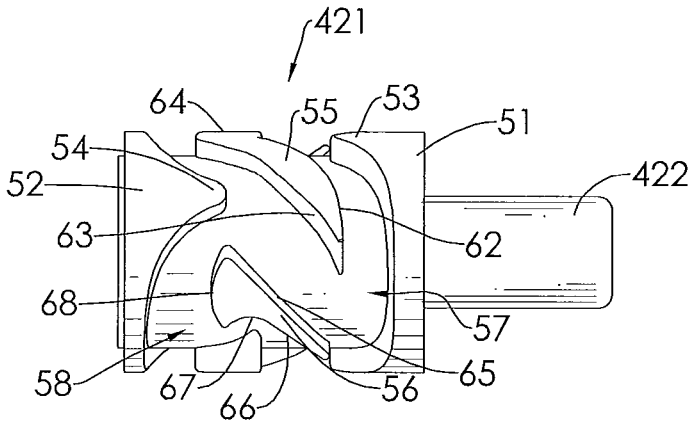
FIG. 8 is another enlarged side view of a rail mount of the positioning device in FIG. 6.
Figure 13:
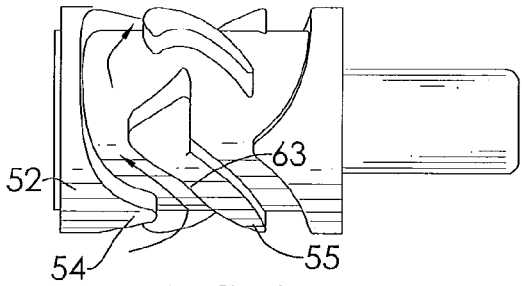
FIGS. 9 to 15 are operational side views of the rail mount of the positioning device in FIG. 6.
Figure 9:
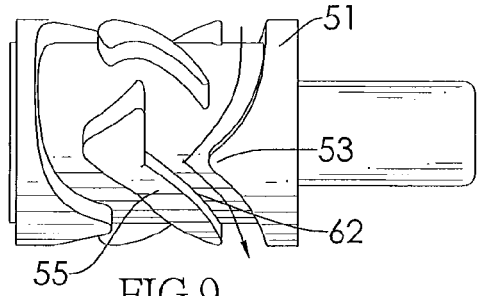
Figure 10:
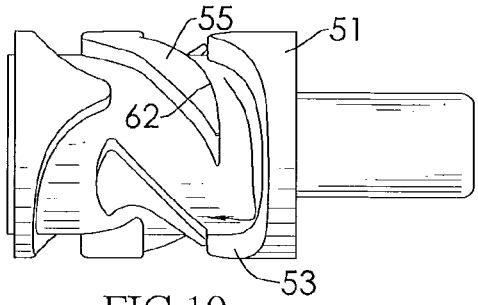
Figure 14:
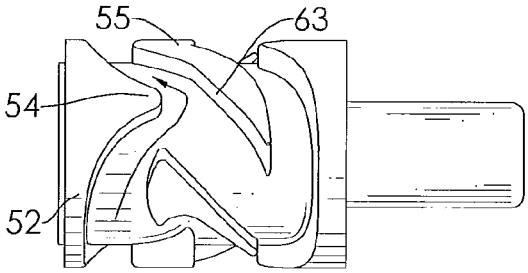

With further reference to FIGS. 6 to 8, the rail segment 421 is formed with the mounting segment 422 of the rail mount 42, is mounted in the rotating mount 41, 41B and is connected securely to the corresponding side cover 16 and has an external surface, an inner side, an outer side, an inner flange 51, an outer flange 52, two inner guiding protrusions 53, two outer guiding protrusions 54, two first guiding blocks 55, two second guiding blocks 56, a first rail 57 and a second rail 58.

The inner flange 51 is formed around and protrudes from the external surface of the rail segment 421 at the inner side of the rail segment 421 and has an inner surface. The outer flange 52 is formed around and protrudes from the external surface of the rail segment 421 at the outer side of the rail segment 421 and has an inner surface. The inner guiding protrusions 53 are formed on and protrude inward from the inner surface of the inner flange 51 at intervals. The outer guiding protrusions 54 are formed on and protrude inward from the inner surface of the outer flange 52 at intervals.

The first guiding blocks 55 are formed on and protrude from the external surface of the rail segment 421 between the flanges 51, 52 and the guiding protrusions 53, 54 at intervals, and each first guiding block 55 has a first side 61, a second side 62, a third side 63 and a fourth side 64. The sides 61, 62, 63, 64 are connected with each other annularly to form around the first guiding block 55. The first side 61 of the first guiding block 55 is formed on and protrudes from the external surface of the rail segment 421 and is parallel with the inner side and the outer side of the rail segment 421. The second side 62 is connected with the first side 61 and extends aslant to one of the inner guiding protrusions 53. The third side 63 is connected with the second side 62 and extends aslant to one of the outer guiding protrusions 54. The fourth side 64 is connected with the third side 63 and the first side 61.

The second guiding blocks 56 are formed on and protrude from the external surface of the rail segment 421 between the flanges 51, 52, the guiding protrusions 53, 54 and the first guiding blocks 55, and each second guiding block 56 has a fifth side 65, a sixth side 66, a seventh side 67 and an eighth side 68. The sides 65, 66, 67, 68 are connected with each other annularly to form around the second guiding block 56. The fifth side 65 of the second guiding block 56 is formed on and protrudes from the external surface of the rail segment 421 between the guiding protrusions 53, 54. The sixth side 66 is connected with the fifth side 65 and extends aslant to one of the inner guiding protrusions 53. The seventh side 67 is connected with the sixth side 66 and extends aslant to one of the outer guiding protrusions 54. The eighth side 68 is connected with the fifth side 65 and the seventh side 67.

The first rail 57 is formed in the rail segment 421 of the rail mount 42 between the guiding blocks 55, 56 and the inner flange 51. The second rail 58 is formed in the rail segment 421 of the rail mount 42 between the guiding blocks 55, 56 and the outer flange 52 and communicates with the first rail 57.

The positioning ball 43 is rotatably mounted between the ball channel 411 of the rotating mount 41, 41B and the rails 57, 58 of the rail segment 421 of the rail mount 42 between the flanges 51, 52, the guiding protrusions 53, 54 and the guiding blocks 55, 56 to enable the rotating mount 41 to rotate relative to the rail mount 42 by the positioning ball 43 moving within the rails 57, 58 and the ball channel 411.

Figure 22:
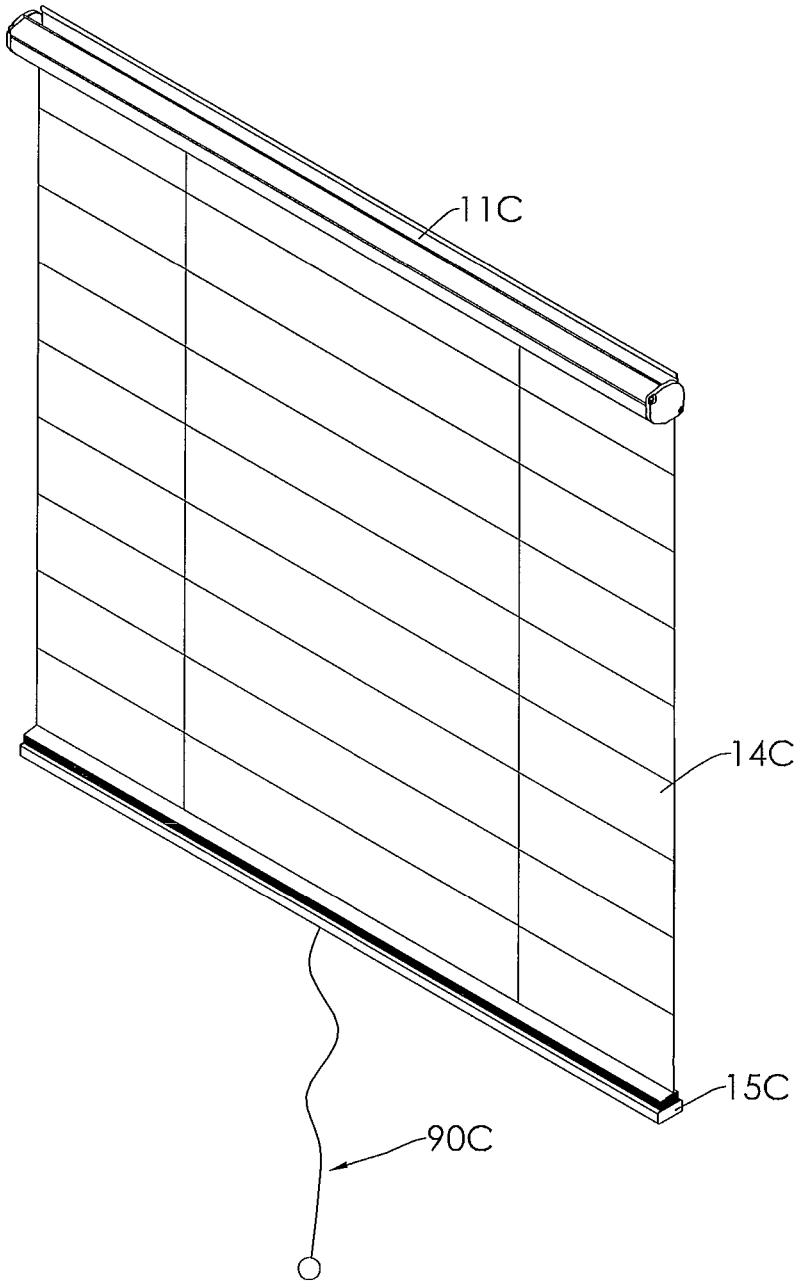
FIG. 22 is a perspective view of a roller blind with a third embodiment of a transmission assembly in accordance with the present invention.

With reference to FIGS. 2, 3, 16 and 22, the blind cloth device is mounted on the bottom of the mounting frame 11, 11B and has a blind cloth 14, 14C, a lower bar 15, 15C and a connecting cord 17. The blind cloth 14, 14C is connected to the roller 12, 12B and has a lower side. The lower bar 15, 15C is mounted on the lower side of the blind cloth 14, 14C. The connecting cord 17 is wound around the outer thread 321 of the winding jacket 32 and is connected securely to the lower bar 15, 15C. With reference to FIG. 22, the blind cloth device further has a lift cord 90C connected to the lower bar 15C to control the movement of the lower bar 15C and the blind cloth 14C when the mounting frame 11C is mounted at a high position.

With reference to FIGS. 18 to 21, the second embodiment of the transmission assembly for a roller in accordance with the present invention further has a damping device 80B. The damping device 80B is mounted securely in the roller 12B and has a mounting head 81B, an outer tube 82B, an inner tube 83B, a minor damper 84B and a torsional spring 85B.

The mounting head 81B is connected to one of the side covers 16B that is opposite to the positioning device 40B, is mounted securely in the roller 12B and has an inner end, an outer end, a head segment, a threaded segment 811B, a quadrate segment 812B and a guiding segment 813B. The head segment is formed on the outer end of the mounting head 81B, is mounted on an end of the roller 12B opposite to the positioning device 40B and has an inner side. The threaded segment 811B is formed on and protrudes from the inner side of the head segment of the mounting head 81B, is mounted in the roller 12B and has an inner end. The quadrate segment 812B is formed on and protrudes from the inner end of the threaded segment 811B and has an inner end. The guiding segment 813B may be semicircular and is formed on and protrudes from the inner end of the quadrate segment 812B.

The outer tube 82B is hollow, is movably mounted in the roller 12B and is screwed with the mounting head 81B and has two open ends. One of the open ends of the outer tube 82B is screwed with the threaded segment 811B of the mounting head 81B. The inner tube 83B is hollow, is movably mounted in the outer tube 82B and is movably mounted around the quadrate segment 812B of the mounting head 81B and has an internal surface and two open ends. The internal surface of the inner tube 83B is mounted around the quadrate segment 812B of the mounting head 81B to prevent the quadrate segment 812B of the mounting head 81B from rotating relative to the inner tube 83B. The quadrate segment 812B of the mounting head 81B extends into the inner tube 83B via one of the open ends of the inner tube 83B.

The minor damper 84B is connected securely to the outer tube 82B and has a center and a turning rod 841B. The turning rod 841B is formed on and protrudes from the center of the minor damper 84B and is mounted in the inner tube 83B. The torsional spring 85B is mounted securely around the turning rod 841B of the minor damper 84B and is connected securely to the inner tube 83B.

In use, with reference to FIGS. 2, 16, 17 and 22, the mounting frame 11, 11B, 11C is mounted on a side of a window frame. When a user wants to expand the blind cloth 14, 14C by pulling the lower bar 15, 15C or the lift cord 90C, the winding jacket 32 will be rotated with the connecting cord 17 relative to the mounting sleeve 31. Then, the roller 12, 12B will be rotated in the same direction with the winding jacket 32 by the engagement between the winding balls 33, the ball recesses 322 and the ball grooves 121. When the roller 12, 12B is rotated by the winding jacket 32, the coil spring 13, 13B connected securely between roller 12, 12B and the rail mount 42 will be twisted by the roller 12, 12B to store an elastic potential energy.

With further reference to FIG. 6, when the user stops expanding the blind cloth 14, 14C, the rotating mount 41, 41B, the rail mount 42 and the positioning ball 43 of the positioning device 40 will be moved and engage each other (the movement between the rotating mount 41, 41B, the rail mount 42 and the positioning ball 43 of the positioning device 40 will be stated as follows). Consequently, the roller 12, 12B and the coil spring 13, 13B can be kept from rotating because the rotating mount 41, 41B is mounted securely in the roller 12, 12B and the rail mount 42 is connected securely to the coil spring 13, 13B. Then, the bind cloth 14, 14C can be held at a desired height relative to the window frame.

In addition, to fold the blind cloth 14, 14C to the original position, the lower bar 15, 15C or the lift cord 90C is slightly pulled downward and then released. Then, the rotating mount 41, 41B, the rail mount 42 and the positioning ball 43 of the positioning device 40 will be moved and disengaged from each other (the movement between the rotating mount 41, 41B, the rail mount 42 and the positioning ball 43 of the positioning device 40 will be stated as follows). Consequently, the coil spring 13, 13B can be rotated in reverse by the stored elastic potential energy to make the blind cloth 14, 14C winding upward to the original position.

Figure 16:
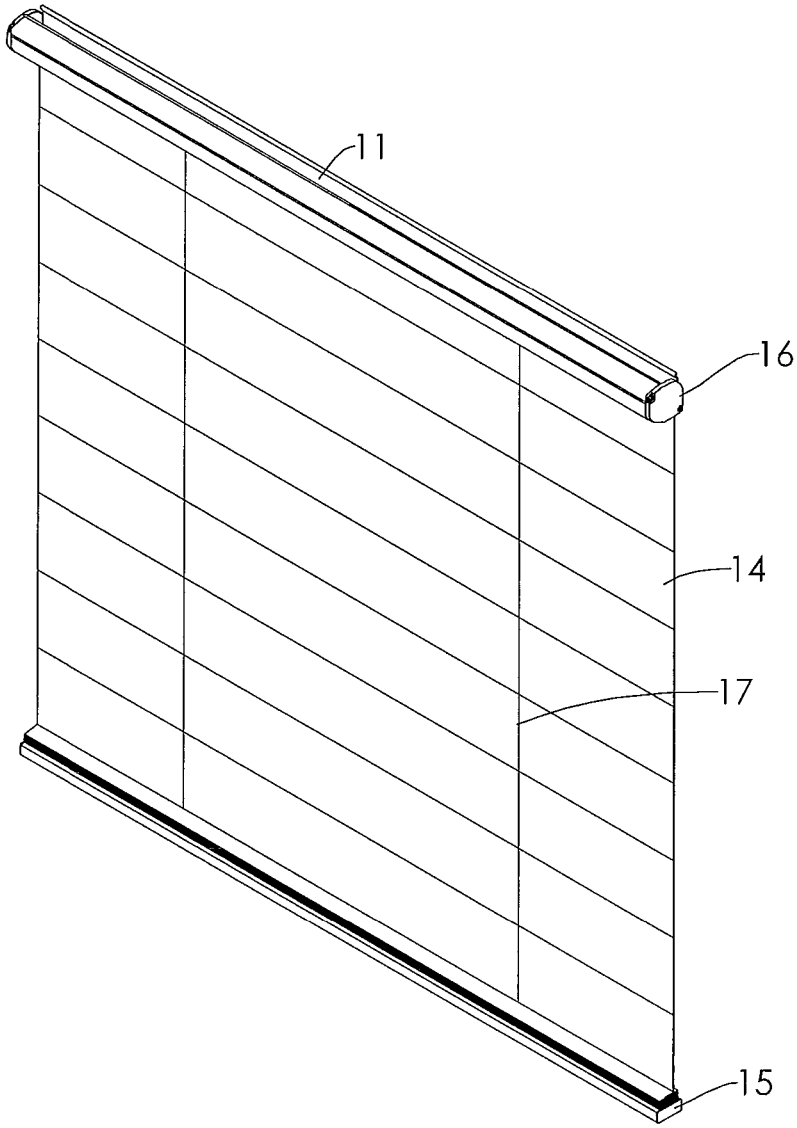
FIG. 16 is an operational perspective view of a roller blind with the transmission assembly in FIG. 1.
Figure 17:
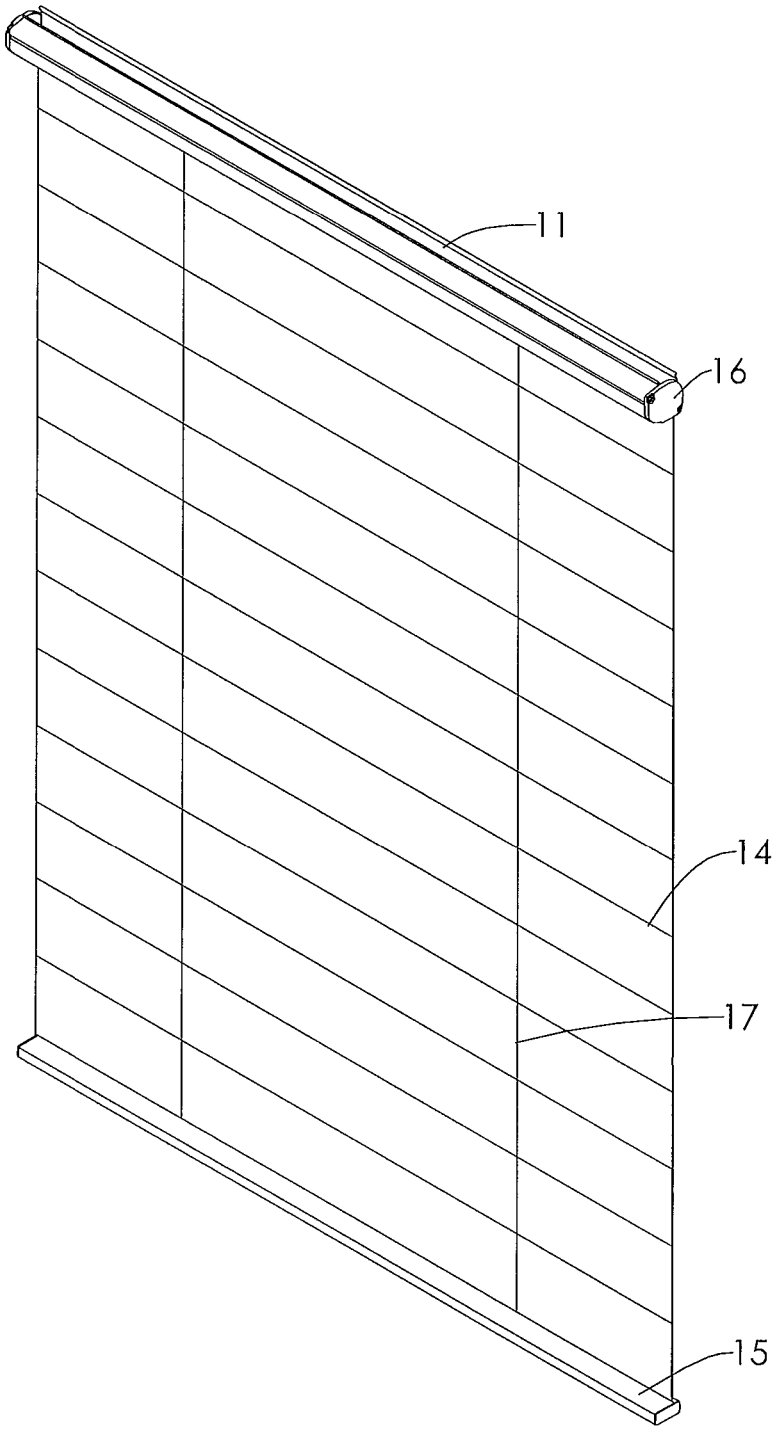
FIG. 17 is another operational perspective view of a roller blind with the transmission assembly in FIG. 1.

During the blind cloth 14, 14C moves relative to the mounting frame 11, 11B, 11C, the positioning ball 43 moves between the rotating mount 41, 41B and the rail mount 42 to enable the rotating mount 41, 41B engaging or disengaging from the rail mount 42. With reference to FIGS. 2, 6 and 16, when the blind cloth 14, 14C moves downward relative to the window frame, the rotating mount 41, 41B will rotate with the roller 12, 12B relative to the rail mount 42 to enable the positioning ball 43 to move in the rail segment 421 of the rail mount 42. With reference to FIGS. 6 to 10, if the original position of the positioning ball 43 is set in the first rail 57, the positioning ball 43 can be moved downward along the inner flange 51, outward along the inner guiding protrusions 53, downward along the second sides 62 of the first guiding blocks 55 and the inner flange 51 repeatedly. Accordingly, the rotating mount 41, 41B can rotate relative to the rail mount 42 and the blind cloth 14, 14C can be expanded relative to the window frame.

Figure 11:
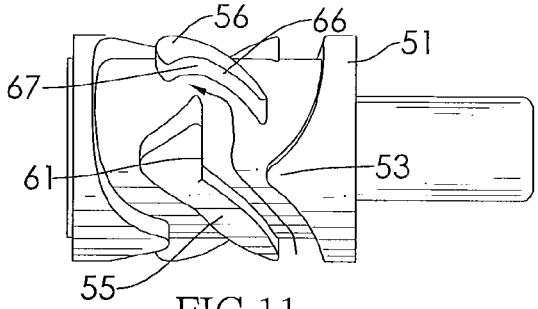

With reference to FIGS. 2, 6 and 16, when the blind cloth 14, 14C is stopped expanding, the rotating mount 41, 41B will rotate in reverse slightly due to the stored elastic potential energy of the coil spring 13, 13B. The positioning ball 43 will move upward along and separate from one of the inner guiding protrusions 53, moves upward along the first side 61 of the adjacent first guiding block 55 and engages between the sixth side 66 and the seventh side 67 of the adjacent second guiding block 56 as shown in FIG. 11. Then, the rotating mount 41, 41B cannot rotate relative to the rail mount 42 due to the engagement between the corresponding second guiding block 56 and the positioning ball 43 Furthermore, The roller 12, 12B and the coil spring 13, 13B are kept from rotating, such that the blind cloth 14, 14C can be held at a desired height relative to the window frame as shown in FIG. 16.

Figure 12:
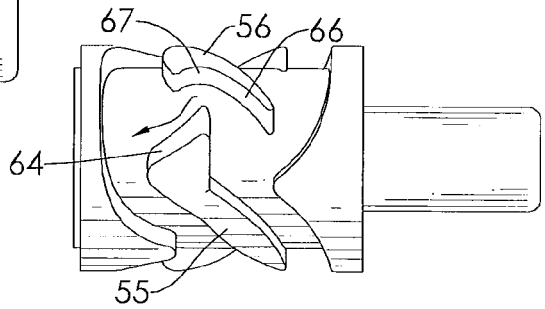

With reference to FIGS. 2, 6 to 8 and 12, if the user wants to draw the blind cloth 14, 14C upward to the original position, the lower bar 15, 15C or the lift cord 90C is slightly pulled downward to enable the positioning ball 43 to move downward to disengage and separate from the sixth side 66 and the seventh side 67 of the corresponding second guiding block 56. Then, the positioning ball 43 will move downward along the fourth side 64 of the adjacent first guiding block 55 and move into the second rail 58 of the rail segment 421 as shown in FIG. 12.

Furthermore, with reference to FIGS. 6 to 8, 13 and 14, the positioning ball 43 can be moved in the second rail 58 upward along the outer flange 52, inward along the outer guiding protrusions 54 and upward along the third sides 63 of the first guiding blocks 55 and the outer flange 52 repeatedly and this can enable the rotating mount 41, 41B to rotate in reverse relative to the rail mount 42. Accordingly, the blind cloth 14, 14C can be drawn upward relative to the window frame and to the original position with the stored elastic potential energy of the coil spring 13, 13B.

Figure 15:
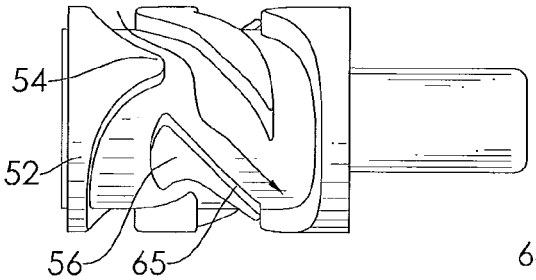

With reference to FIGS. 2, 6 and 16, if the positioning ball 43 moves in the second rail 58 as the above-mentioned and when the user wants to expand the blind cloth 14, 14C again, the rotating mount 41, 41B will rotate relative to the rail mount 42. At this time, the positioning ball 43 will be moved downward along the outer flange 52, inward along the outer guiding protrusions 54 and downward along the fifth sides 65 of the second guiding blocks 56 to the first rail 57 as shown in FIG. 15. Then, the positioning ball 43 can be moved in the first rail 57 as the above mentioned, such that the blind cloth 14, 14C can be drawn downward relative to the window frame and be held at a desired height.

With reference to FIGS. 4 and 8, when the blind cloth 14, 14C is moved upward relative to the window frame, the winding jacket 32 will rotate and move relative to the mounting sleeve 31 with the engagement between the inner thread 311 and the outer thread 321. Accordingly, the connecting cord 17 can wind averagely around the whole outer thread 321 of the winding jacket 32 and can be kept from stacking on a same position at the winding jacket 32 and from contacting the mounting frame 11, 11B, 11C or winding with each other. Then, the blind cloth 14, 14C can be drawn upward or downward relative to the window frame smoothly. In addition, the winding balls 33 are pointedly in contact with the ball recesses 322 of the winding jacket 32 and the ball grooves 121 of the roller 12, 12B, and this enable the winding jacket 32 to rotate at the same direction with the roller 12, 12B.

With reference to FIGS. 2 and 5, the torsional spring 23 is mounted securely in the mounting end of the turning element 24 and is mounted securely around and abuts securely the turning rod 221 of the major damper 22 to avoid the torsional spring 23 from moving relative to the turning rod 221 of the damper 22. In addition, with reference to FIGS. 2 and 5, the turning element 24 is seriatim connected securely to the spring axle 21, the rail mount 42 and the side cover 16 and is kept rotate relative to the torsional spring 23. When the blind cloth 14, 14C moves downward, the coil spring 13, 13B and the major damper 22 will be rotated with the roller 12, 12B and the torsional spring 23 will be loosen and being released from the turning rod 221 and the turning rod 221 can be rotated with the major damper 22.

When the blind cloth 14, 14C moves upward, the coil spring 13, 13B and the major damper 22 will be rotated in reverse with the roller 12, 12B, the turning rod 221 will be rotated with the major damper 22 to abut tighter with the torsional spring 23. Then, the torsional spring 23 that abuts tighter with the turning rod 221 will enable the turning rod 221 to rotate in a reverse direction relative to the rotating direction of the major damper 22, the contrary rotating directions between the turning rod 221 and the major damper 22 can provide a resistance force between the major damper 22, the coil spring 13, 13B and the roller 12, 12B. The resistance force prevents the blind cloth 14, 14C from moving upward too fast and accidents from occurring.

With further reference to FIGS. 18 to 21, the movement of the damping device 80B can be divided into four steps.

In the first step, the blind cloth 14 is moved downward to a half of the height of the fully expanded blind cloth 14, the outer tube 82B is rotated with the roller 12B, the mounting head 81B is connected securely to the corresponding side cover 16B and this will enable the outer tube 82B to rotate relative to the threaded segment 811B of the mounting head 81B and to move away the mounting head 81B along the threaded segment 811B. The inner tube 83B will move inward with the outer tube 82B by the abutting and pressing force of the outer tube 82B. At this time, the minor damper 84B is rotated with the outer tube 82B to enable the turning rod 841B to rotate with the minor damper 84B. However, the torsional spring 85B is mounted and abuts securely on the turning rod 841B and is connected securely to the inner tube 83B, and the inner tube 83B is kept from being rotated due to the engagement between the internal surface of the inner tube 83B and the quadrate segment 812B of the mounting head 81B. Therefore, the contrary rotating directions between the turning rod 841B and the minor damper 84B, and the torsional spring 85B will be loosen and being released from the turning rod 841B of the minor damper 84B to enable the turning rod 841B to rotate relative to the inner tube 83B and the blind cloth 14 can be moved downward smoothly without any resistance force.

Figure 21:
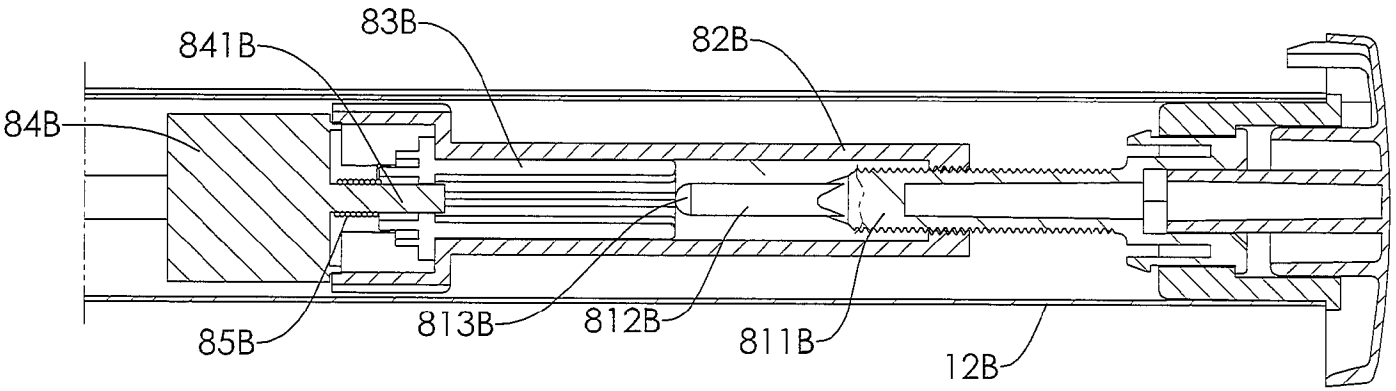
FIG. 21 is an enlarged operational side view in partial section of the transmission assembly for a roller blind in FIG. 18.

In the second step, the blind cloth 14 is moved downward over the half of the height of the full-spread blind cloth 14, with reference to FIG. 21, the inner tube 83B is completely separated from the mounting head 81B and is rotated with the minor damper 84B by the turning rod 841B. In the second step, the turning rod 841B is rotated in the same direction with the minor damper 84B and this may not form any resistance force between the turning rod 841B and the minor damper 84B. Therefore, the blind cloth 14 can be moved downward smoothly to the height of the full-spread blind cloth 14.

In the third step, the blind cloth 14 is moved upward from the height of the full-spread blind cloth 14 to the half of the full-spread blind cloth 14, the inner tube 83B is still separated from the mounting head 81B and can be rotated relative to the mounting head 81B. At this time, the outer tube 82B is rotated with the roller 12 to move toward the mounting head 81B along the threaded segment 811B of the mounting head 81B, and the outer tube 82B is connected securely to the minor damper 84B. Then, the minor damper 84B is rotated with the outer tube 82B to move and abut the inner tube 83B, and the inner tube 83B can be moved toward the mounting head 81B. In addition, when the turning rod 841B is rotated with the minor damper 84B, the torsional spring 85B can be rotated with the inner tube 83B as the same rotating direction of the turning rod 841B without providing a resistance force between the torsional spring 85B and the minor damper 84B. Then, the blind cloth 14 can be moved upward smoothly without any resistance force.

In the fourth step, the blind cloth 14 is moved upward over the hale of the height of the full-spread blind cloth 14 to the original position, the inner tube 83B is moved relative to the mounting head 81B to enable the internal surface of the inner tube 83B to engage the quadrate segment 812B via the guiding segment 813B of the mounting head 81B. Then, the inner tube 83B cannot be rotated relative to the mounting head 81B. The torsional spring 85B is connected securely to the inner tube 83B and the turning rod 841B of the minor damper 84B. The rotating direction of the turning rod 841B in the fourth step is different from the rotating direction of the turning rod 841B in the first step and is rotated to abut tighter with the torsional spring 85B by the torsional spring 85B connected securely to the inner tube 83B. Then, the torsional spring 85B can be used to limit the rotating direction of the turning rod 841B. However, the minor damper 84B is connected securely to the outer tube 82B and is rotated in a contrary direction relative to the turning rod 841B and this will form a resistance force between the minor damper 84B and the turning rod 841B. Then, the resistance force can be used to prevent the blind cloth 14 from moving upward too fast.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A transmission assembly for a roller blind having a blind cloth device with a blind cloth, a lower bar mounted on a lower side of the blind cloth, a connecting cord connected securely to the lower bar and a lift cord connected to the lower bar and the transmission assembly comprising:

a mounting frame being hollow and having two open ends and a bottom being adapted to connect with a blind cloth device;

at least one winding device mounted in the mounting frame and each one of the at least one winding device having a mounting sleeve being hollow, mounted securely in the mounting frame and having two open ends;

an internal surface; and an inner thread formed on the internal surface of the mounting sleeve;

a winding jacket being hollow, rotatably mounted in the mounting sleeve and having two open ends respectively extending out of the open ends of the mounting sleeve;

an external surface;

an internal surface;

an outer thread formed around the external surface of the winding jacket and screwed with the inner thread of the mounting sleeve; and two ball recesses formed in the internal surface of the winding jacket and formed through one of the open ends of the winding jacket;

two winding balls rotatably and respectively mounted in the ball recesses of the winding jacket; and a stopping ring mounted on a corresponding open end of the winding jacket through which the ball recesses are formed, the stopping ring having two stopping arms respectively mounted in the ball recesses of the winding jacket; and a roller rotatably mounted in the mounting frame, securely connected to the winding jacket of the at least one winding device, being adapted to the blind cloth of the blind cloth device and having;

an external surface; and two ball grooves formed in the external surface of the roller and respectively aligning with the ball recesses of the winding jacket of the at least one winding device to hold the winding balls between the ball grooves of the roller and the ball recesses of the winding jacket of the at least one winding device;

a coil spring mounted securely in the roller and having an inner end mounted securely in the roller; and an outer end;

a spring axle mounted in the coil spring between the ends of the coil spring and having an inner end and an outer end;

a turning element connected to the inner end of the spring axle and having an inserting end mounted securely in the inner end of the spring axle; and a mounting end;

a torsional spring mounted securely in the mounting end of the turning element;

a major damper connected securely to the inner end of the coil spring that is securely mounted in the roller, the major damper connected securely to the torsional spring and having an inner side; and a turning rod formed on and protruding from the inner side of the major damper and mounted securely and abutting securely the torsional spring; and a positioning device mounted securely in the roller, rotatably abutting the outer end of the spring axle and having a rotating mount being hollow, mounted securely in the roller and having two open ends, and one of the open ends of the rotating mount rotatably abutting the outer end of the spring axle;

an internal surface; and a ball channel formed longitudinally in the internal surface of the rotating mount;

a rail mount mounted in the rotating mount and having a mounting segment extending through one of the open ends of the rotating mount and connected securely to the outer ends of the coil spring and the spring axle; and a rail segment formed with the mounting segment of the rail mount, the rail segment mounted in the rotating mount and having an external surface;

an inner side;

an outer side;

an inner flange formed around and protruding from the external surface of the rail segment at the inner side of the rail segment and having an inner surface;

an outer flange formed around and protruding from the external surface of the rail segment at the outer side of the rail segment and having an inner surface;

two inner guiding protrusions formed on and protruding inward from the inner surface of the inner flange at intervals;

two outer guiding protrusions formed on and protruding inward from the inner surface of the outer flange at intervals;

two first guiding blocks formed on and protruding from the external surface of the rail segment between the flanges, the inner guiding protrusions and the outer guiding protrusions at intervals;

two second guiding blocks formed on and protruding from the external surface of the rail segment between the flanges, the inner guiding protrusions, the outer guiding protrusions and the first guiding blocks;

a first rail formed in the rail segment of the rail mount between the guiding blocks and the inner flange; and a second rail formed in the rail segment of the rail mount between the guiding blocks and the outer flange and communicating with the first rail; and a positioning ball rotatably mounted between the ball channel of the rotating mount and the rails of the rail mount between the inner guiding protrusions, the outer guiding protrusions, the first guiding blocks and the second guiding blocks.

2. The transmission assembly for a roller blind as claimed in claim 1, wherein the blind cloth device has a blind cloth; the blind cloth has a lower side; the blind cloth device further has a lower bar mounted on the lower side of the blind cloth; and a connecting cord wound around the outer thread of the winding jacket and connected securely to the lower bar; and a lift cord connected to the lower bar.

3. The transmission assembly for a roller blind as claimed in claim 1, wherein the transmission assembly has a damping device mounted securely in the roller and having a mounting head mounted securely in the roller and having an inner end;

an outer end;

a head segment formed on the outer end of the mounting head, mounted on an end of the roller opposite to the positioning device and having an inner side;

a threaded segment formed on and protruding from the inner side of the head segment of the mounting head, mounted in the roller and having an inner end;

a quadrate segment formed on and protruding from the inner end of the threaded segment and having an inner end; and a guiding segment being semicircular and formed on and protruding from the inner end of the quadrate segment;

an outer tube being hollow, movably mounted in the roller and screwed with the mounting head and having two open ends, and one of the open ends of the outer tube screwed with the threaded segment of the mounting head;

an inner tube being hollow, movably mounted in the outer tube and movably mounted around the quadrate segment of the mounting head and having an internal surface mounted around the quadrate segment of the mounting head to prevent the quadrate segment of the mounting head from rotating relative to the inner tube; and two open ends, and the quadrate segment extending into the inner tube via one of the open ends of the inner tube;

a minor damper connected securely to the outer tube and having a center; and a turning rod formed on and protruding from the center of the minor damper and mounted in the inner tube; and a torsional spring mounted securely around the turning rod of the minor damper and connected securely to the inner tube.

4. The transmission assembly for a roller blind as claimed in claim 3, wherein the transmission assembly has two side covers respectively connected to the open ends of the mounting frame to hold the roller in the mounting frame;

the positioning device is connected securely to one of the side covers;

the rail mount is mounted securely on the corresponding side cover that is connected to the rotating mount; and the mounting head is connected to the other side covers that is opposite to the positioning device.

* * * * *